US006185276B1

(12) United States Patent
Eastman

(10) Patent No.: US 6,185,276 B1
(45) Date of Patent: Feb. 6, 2001

(54) COLLIMATED BEAM X-RAY TUBE

(75) Inventor: G. Yale Eastman, Lancaster, PA (US)

(73) Assignee: Thermal Corp., Georgetown, DE (US)

( * ) Notice: Under 35 U.S.C. 154(b), the term of this patent shall be extended for 0 days.

(21) Appl. No.: 09/243,704

(22) Filed: Feb. 2, 1999

(51) Int. Cl.[7] ..... H01J 35/08

(52) U.S. Cl. ..... 378/143; 378/124; 378/140; 378/121

(58) Field of Search ..... 378/143, 124, 378/140, 121

(56) References Cited

U.S. PATENT DOCUMENTS

| | | | | |
|---|---|---|---|---|
| 3,564,251 | * | 2/1971 | Youmans . | |
| 3,821,579 | | 6/1974 | Burns | 313/55 |
| 3,898,455 | | 8/1975 | Furnas, Jr. | 250/280 |
| 4,065,211 | | 12/1977 | Vig | 356/152 |
| 4,126,805 | * | 11/1978 | Randall . | |
| 4,266,138 | | 5/1981 | Nelson et al. | 250/492 A |
| 4,352,021 | | 9/1982 | Boyd et al. | 378/12 |
| 4,405,876 | * | 9/1983 | Iversen . | |
| 4,573,186 | * | 2/1986 | Reinhold . | |
| 5,001,737 | | 3/1991 | Lewis et al. | 378/147 |
| 5,008,910 | | 4/1991 | Van Egeraat | 378/84 |
| 5,148,462 | * | 9/1992 | Spitsyn et al. . | |
| 5,199,058 | | 3/1993 | Tani et al. | 378/82 |
| 5,550,889 | * | 8/1996 | Gard et al. . | |
| 5,604,782 | | 2/1997 | Cash | 378/85 |

* cited by examiner

*Primary Examiner*—David P. Porta
*Assistant Examiner*—Pamela R. Hobden
(74) *Attorney, Agent, or Firm*—Martin Fruitman

(57) ABSTRACT

The apparatus is an x-ray tube which generates collimated x-rays. The x-ray tube anode has an x-ray generating structure which is a single crystal, so that regardless of their locations of origin all the x-ray beams leave the structure at the same limited few angles. With the structure formed as a curve, one set of beams converges at the focal point of the curve, and with the structure flat, the beams illuminate an area with parallel, collimated, x-ray beams.

12 Claims, 2 Drawing Sheets

COLLIMATED BEAM X-RAY TUBE

BACKGROUND OF THE INVENTION

This invention deals generally with x-ray tubes and more specifically with an x-ray tube which generates highly collimated radiation.

X-ray tubes function on the basis of an electron beam being generated by a cathode within the tube, and the electron beam bombarding a very small spot on an anode which is also within the tube. The bombardment of the anode, which is constructed of a suitable x-ray generating material, creates the x-rays along with a great deal of heat.

Until now most x-ray tubes have generated radiation which is poorly focused and have required secondary structures or devices to focus the beam on an object to be studied. Typical focusing structures external to the x-ray source have been spherical mirrors (U.S. Pat. No. 5,604,782 by Cash), curved crystals (U.S. Pat. 5,008,910 by Van Egeraat), capillary tubes (U.S. Pat. No. 5,001,737 by Lewis et al), and bent crystals on the inside surface of tubular structures (U.S. Pat. No. 3,898,455 by Furnas, Jr.).

A few efforts have also been made to generate a more focussed beam within the x-ray tube itself. In U.S. Pat. No. 4,352,021 by Boyd et al, multiple curvelinear anodes are disclosed, but they are also followed by a collimator structure to improve the focus. In U.S. Pat. No. 3,821,574, Burns discloses a single crystal anode of elongated channel shape which is used to generate a more intense x-ray beam because the beam is diffracted from the single crystal structure many times as it travels along the channel.

Despite this prior art, a simple structure for an x-ray tube which produces a collimated beam is not available. It would be very beneficial for both industrial and medical applications to have available an x-ray tube which is essentially interchangeable with x-ray tubes in common use but which produces a highly collimated beam which requires minimal external focusing devices.

SUMMARY OF THE INVENTION

The present invention is an x-ray tube which generates a highly collimated beam within the x-ray tube itself. To accomplish this a single crystal or a highly oriented coating is used for the x-ray generating anode (or target) of the tube. To generate a focused beam, this single crystal structure is attached to a spherical or parabolic surface. Thus, x-ray photons which leave the structure on a path perpendicular to the surface are focused at a specific focal point determined by the curvature of the single crystal.

For some applications it may be desirable to produce a collimated beam which is not focused, that is, a beam which actually is comprised of multiple parallel individual beams. Such a beam, which can, for instance, be used in large area illumination of photolithographic masks, can be generated by the use of a single crystal attached to or comprising a flat anode surface.

The x-ray photons are generated in a conventional manner by bombarding the anode with electrons from an electron source within the x-ray tube. The electrons emitted from the source are accelerated to a high velocity before striking the anode by the use of a voltage gradient between the electron source and the anode. The voltage gradient is established by the application of appropriate voltages to the electrodes from an external power supply.

The electron beam can also be scanned by a magnetic deflection coil, similar to that used in television picture tubes. Such scanning permits the generation of x-rays from multiple points on a large surface as opposed to the more traditional manner of directing the electron beam to a single location on the anode, and, in some x-ray tubes, rotating the anode so that no single location on the anode overheats.

The benefit derived from the single crystal structure is the limited number of paths followed by photons generated within the crystal lattice and the parallelism of all the photons emitted in any one of the limited directions. Photons which try to leave the crystal lattice in directions other than the several preferred paths are refracted into the preferred paths or absorbed by the crystal lattice and re-emitted in one of the preferred paths. Thus, if the anode surface is perfectly flat, although photons are emitted at several specific angles to the surface, all the photons leaving the surface at each of the specific beam angles will be parallel to all the other beams of photons departing from the surface, even though the photons are generated at multiple locations within the crystal lattice.

In more familiar terms, the emission of x-rays from each spot on a single crystal anode structure is similar to the illumination from the narrow beams of several spotlights positioned at a single location, so that they form a limited number of narrow beams of light from that location. Furthermore, all other locations on the anode generate only light beams which are parallel to those from the first location.

In a similar example, each x-ray generating spot of a typical prior art x-ray anode can be represented by a single simple incandescent light bulb which sends out photons in a full semi-spherical pattern. Just as we regularly do with flashlights and search lights, the x-rays from conventional anodes must then be focused with reflectors and lenses.

However, the focus of x-rays from a single crystal structure can be determined, not by external focusing devices, but by the curvature of the anode surface itself. When the surface is parabolic, the x-rays will be focused at the focal point of the parabola, and if the surface is perfectly flat the x-rays will simply generate a shaft of parallel collimated x-ray beams.

This pattern of collimated beams is particularly useful in the photolithography process used in the semiconductor industry. The number of circuit elements which can be squeezed into a specific area is now approaching a new limit, the resolution available with the light used for illuminating the photolithography mask. The minimum spacing between individual elements is limited by the wavelength and collimation of the light used for transferring the image from the mask to the semiconductor material. An x-ray beam generated by a single crystal can take this process to the next level because the wavelengths of x-rays are not only much shorter than those of visible light but they are also collimated.

Thus, the present invention can not only furnish better focused x-rays for use in conventional medical and industrial uses, but can also yield shorter wavelength collimated beams for improving the integrated circuit manufacturing process.

DETAILED DESCRIPTION OF INVENTION

Figure 1:
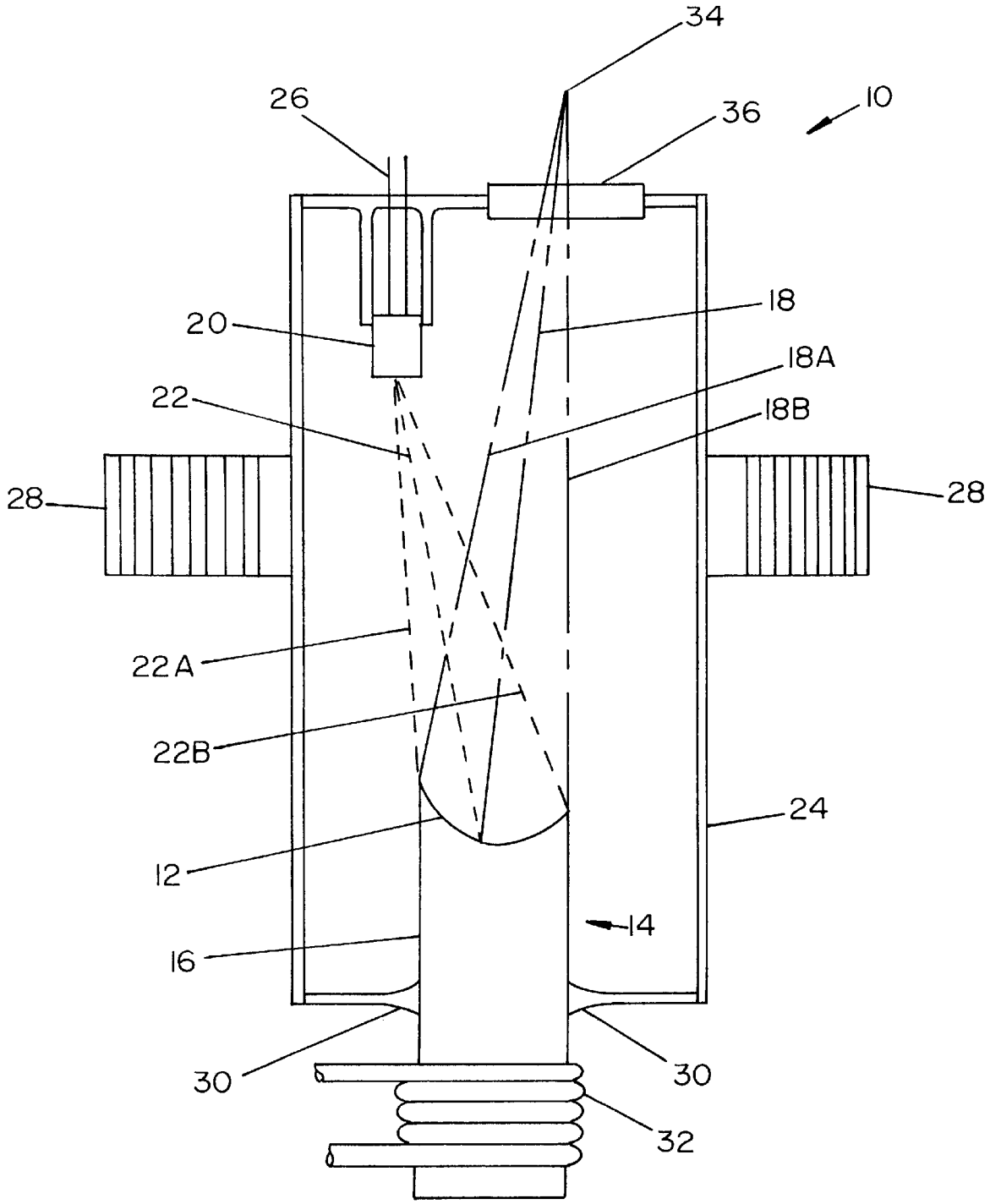
FIG. 1 is a schematic representation of a partial cross section side view of the preferred embodiment of the invention.

FIG. 1 is a schematic representation of a partial cross section side view of x-ray tube 10 within which electron bombarded and x-ray generating structure 12 of anode 14 is attached to and cooled by a base structure, which is heat pipe 16, while generating x-ray beam 18. Such a tube is constructed with cathode 20 mounted within evacuated envelope 24 and interconnected to suitable power supplies (not shown) by cathode connections 26 which penetrate envelope 24. Electron beam 22 originates at cathode 20 and bombards x-ray generating structure 12.

FIG. 1 also schematically depicts a structure which can be used to control electron beam 22. Magnetic coil 28 is a device which can deflect electron beam 22 in any direction along bombarded structure 12, as indicated by beam lines 22A and 22B. However, it should be appreciated that there are other devices in the art, such as electrostatic plates, which can also be used to deflect electron beam 22 and scan it across structure 12.

Heat pipe 16 penetrates envelope 24 and is sealed to it at vacuum seals 30 by conventional means. Heat pipe 16 eliminates the need to rotate anode 14 because heat pipe 16 is capable of cooling bomdarded structure 12 well enough to prevent thermal damage to structure 12 by the electron beam.

In this embodiment, in order to sufficiently cool bombarded structure 12, heat pipe 16 is constructed with a tungsten casing, lithium fluid, and a niobium powder wick for high power density operation. Heat pipe 16 removes the heat generated at the spots at which electron beam 22 bombards structure 12. Cooling coil 32, located at the condenser end of heat pipe 16, and through which a cooling fluid is pumped, then moves the heat from heat pipe 16 to a remote heat exchanger (not shown).

Elimination of the need to rotate anode 14 complements the ability to deflect electron beam 22 because it permits full electronic control of the location of the spots which generate x-ray beam 34. With the structure shown in FIG. 1, the electron beam can be moved around structure 12 instead of requiring the rotation of anode 14. Furthermore, with the rotation of the anode eliminated, the invention is not restricted to circular layouts for x-ray generating structure 12. Thus, it is quite practical to construct anode 14 and heat pipe 16 with rectangular plan views, and with the concave cross section of structure 12 as shown in FIG. 1, to generate x-rays which yield a linear configuration on the illuminated surface.

However, the present invention also uses special material for x-ray generating structure 12 which gives x-ray beam 34 special characteristics and increased versatility. Structure 12 is constructed as a single crystal or a highly oriented coating of a material such as tungsten. Such a highly oriented coating can be produced by chemical vapor deposition, a process well understood in the art of material coating.

For the preferred embodiment, structure 12 is a single crystal structure of tungsten with a thickness of 0.001 to 0.010 inch. However, many other materials can be produced as single crystal structures, and each material has different x-ray generating characteristics such as wavelength and beam orientation. These characteristics of materials are well documented in the literature dealing with x-rays.

The characteristic of such a single crystal structure is that there are a limited number of exit paths available to the photons generated within the crystal lattice of the material, and that all the photon emission paths originating from any location on the structure are parallel to the emission paths originating at all the other locations. Thus, for a flat structure, although photons are emitted at several specific angles to the surface, all locations on the structure will emit photons at only the same few limited angles at which every other location emits photons, and the result will be many parallel beams of photons leaving the structure at each of the limited number of angles.

In the simplest case which is illustrated in FIG. 1, if one of the exit path angles for a particular material is perpendicular to structure 12, any spot of structure 12 which is bombarded by electron beam 22 will generate, along with a limited number of other x-ray beams, an x-ray beam 18 exiting perpendicular to structure 12. Therefore, when structure 12 is shaped as a parabola or a small radius sphere approximating a parabola, the x-ray beams from all locations of structure 12 exit perpendicular to parabolic structure 12. Those beams, such as beams 18A and 18B, then meet at focal point 34, after exiting tube 10 through window 36, regardless of where on structure 12 they originated.

It should be appreciated that parabolic structure 12 is not functioning as a reflector as might be first supposed, but rather as a parabolic radiation generator. Moreover, structure 12 need not necessarily be a parabola, but can be any curved structure to focus a beam at a particular location or locations. A deviation in the curved structure is particularly helpful when the exit angles of the beams from structure 12 which are being used is other than perpendicular.

Figure 2:
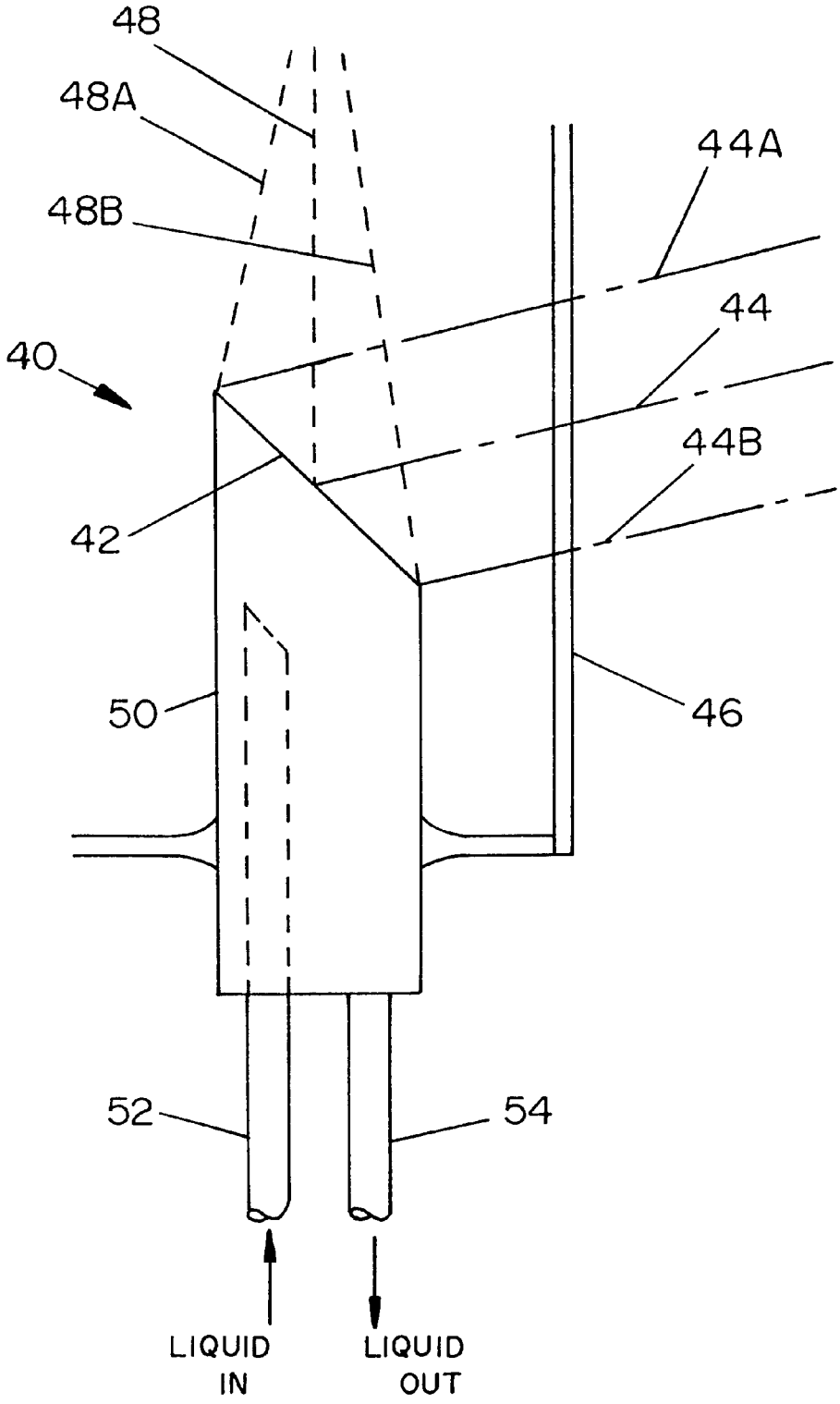
FIG. 2 is a side view of an alternate embodiment of the x-ray generating anode of the invention.

One such variation of the electron bombarded and x-ray generating structure of an anode is depicted in FIG. 2. FIG. 2 is a side view of an alternate embodiment of the x-ray generating anode 40 of the invention in which structure 42 is flat and, as in many x-ray tubes, angled to deliver x-ray beam 44 out the side of the tube wall 46. As in FIG. 1, an electron beam 48 bombards x-ray generating structure 42, and electron beam 48 can be moved over entire structure 42 as is indicated by beam lines 48A and 48B by a deflection coil (not shown).

However, anode 40 in FIG. 2 differs from anode 14 in FIG. 1 because x-ray generating structure 42 is flat so there is no focusing action and also because the angles of exit of x-ray beams 44, 44A, and 44B from structure 42 are not perpendicular to structure 42. Nevertheless, when x-ray beams 44, 44A, and 44B originate from single crystal structure 42, or any highly oriented coating, they are all collimated and parallel to each other regardless of the origin points of the beams. The structure of FIG. 2 therefore makes it possible to illuminate areas equivalent in size to structure 42 itself with x-rays. As previously discussed, such illumination is useful in exposing masked areas in photolithography to x-rays.

FIG. 2 also shows an alternate structure for cooling the x-ray generating structure of the anode. In FIG. 2, x-ray generating structure 42 is attached to hollow casing 50, and high velocity, high turbulence liquid is pumped into casing 50 through input pipe 52 which extends into casing 50 until near structure 42. Output pipe 54 removes the heated liquid from casing 50 and is interconnected to an external heat exchanger (not shown) where the liquid is cooled for return to input pipe 52 by a pump (not shown).

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, various materials can be used in single crystal form to generate different wavelengths of x-rays, and to yield x-ray beams with different exit angles from the single crystal. Furthermore, as previously discussed, materials can be coated onto the anode for the x-ray emitting structure by means of chemical vapor deposition. Such coated materials are also capable of generating highly collimated x-rays.

What is claimed as new and for which Letters Patent of the United States are desired to be secured is:

1. An x-ray tube comprising:

a means for generating an electron beam; and an anode to which the electron beam is directed, the anode comprising a base structure and an x-ray generating surface attached to the base structure, with the electron beam bombarding the surface and generating x-ray radiation, and the x-ray generating surface constructed of a material which generates collimated x-ray beams.

2. The x-ray tube of claim 1 wherein the x-ray generating surface is a single crystal.

3. The x-ray tube of claim 1 wherein the x-ray generating surface is a single crystal of tungsten.

4. The x-ray tube of claim 1 wherein the x-ray generating surface is a highly oriented coating.

5. The x-ray tube of claim 1 further including means for deflecting the electron beam so that the electron beam can scan the x-ray generating surface.

6. The x-ray tube of claim 1 further including a magnetic deflection coil for deflecting the electron beam so that the electron beam can scan the x-ray generating surface.

7. The x-ray tube of claim 1 wherein the x-ray generating surface is curved.

8. The x-ray tube of claim 1 wherein the x-ray generating surface is parabolic.

9. The x-ray tube of claim 1 wherein the x-ray generating structure is flat.

10. The x-ray tube of claim 1 wherein the x-ray generating structure is spherical.

11. The x-ray tube of claim 1 wherein the base structure is a heat pipe.

12. The x-ray tube of claim 1 wherein the base structure is a casing cooled by high velocity liquid supplied to the inside of the casing.

* * * * *